United States Patent [19]

Freitag et al.

[11] Patent Number: 4,495,840

[45] Date of Patent: Jan. 29, 1985

[54] BIT BREAKER

[75] Inventors: Gary T. Freitag, Webster; Roger C. Smith, Houston, both of Tex.

[73] Assignee: Reed Rock Bit Company, Houston, Tex.

[21] Appl. No.: 514,389

[22] Filed: Jul. 15, 1983

[51] Int. Cl.[3] ..... B25B 13/00

[52] U.S. Cl. ..... 81/54; 81/57.16; 81/57.34; 81/57.21; 269/207; 175/315

[58] Field of Search ..... 81/54, 57, 57.16, 57.24, 81/57.34, 57.35, 57.21, 90 C, 129; 269/207, 234, 217; 175/315

[56] References Cited

U.S. PATENT DOCUMENTS

| | | | |
|---|---|---|---|
| 2,332,685 | 10/1943 | Auld et al. | 81/57.16 |
| 3,363,706 | 1/1968 | Feenstra | 175/340 |
| 3,722,603 | 3/1973 | Brown | 81/57.16 |
| 4,057,887 | 11/1977 | Jones et al. | 81/57.16 |
| 4,174,759 | 11/1980 | Arbuckle | 175/67 |
| 4,352,399 | 10/1982 | Davis | 175/315 |

FOREIGN PATENT DOCUMENTS

| | | | |
|---|---|---|---|
| 624442 | 4/1927 | France | 269/207 |

OTHER PUBLICATIONS

Composite Catalog of Oil Field Equipment and Services, 1978–1979, 33rd Edition, World Oil, Houston, Texas, p. 5912.

*Primary Examiner*—James L. Jones, Jr.
*Attorney, Agent, or Firm*—Carl A. Rowold

[57] ABSTRACT

A bit breaker adapted to be fitted in the Kelly drive of a drill rig for detachably securing a rotary drill bit to the Kelly drive to enable the latter to rotate the bit relative to a drill string having an internally threaded lower end portion in one direction to effect a threaded connection between the threaded pin of the bit and the string, and in the other direction to disconnect the bit from the string. The bit breaker comprises a bottom engageable by the bottom of a drill bit for supporting the bit, a top having an opening therein through which the bit may be lowered into engagement with the bottom of the bit breaker and may be raised to remove the drill bit from the bit breaker, and a stop member for selectively securing the bit in fixed annular position in the said opening in the bit breaker. The stop member is slidably mounted on the stated top adjacent the opening therein for movement inwardly and outwardly relative to the opening between an extended position in which the stop member engages the side of the drill bit for holding it against rotation relative to the bit breaker, and a retracted position in which the stop member is spaced and a retracted position in which the stop member is spaced from the drill bit to enable it to be raised and lowered through the opening. The bit breaker further has a lock for selectively locking the stop member in its extended position.

10 Claims, 7 Drawing Figures

BIT BREAKER

BACKGROUND OF THE INVENTION

This invention relates to oil well drilling equipment, and more particularly to a so-called "bit breaker" for use in connecting and disconnecting rotary drill bits to a drill string having a drill collar, drill pipe or a so-called "sub" at its lower end.

This invention involves an improvement over conventional bit breakers comprising a generally square metal plate adapted to be fitted in the socket of a Kelly drive of a drill rig. The plate has an opening therein for receiving the lower end of a conventional tri-cone drill bit to be connected to a drill string. Conventional tri-cone bits, such as shown for example in U.S. Pat. No. 4,174,759, comprise a generally cylindrical bit body, three spaced apart legs extending down from the bit body and terminating in bearing journals at the lower end of the bit, three roller cutters rotatably mounted on the bearing journals, and three nozzles in the bit body, each directing drill fluid under pressure down in the recess between a respective pair of adjacent roller cutters.

The opening in the bit breaker is configured to correspond to the shape of the lower end of a tri-cone bit of a predetermined size. The conventional bit breaker thus has so-called "breakout lugs" extending into the opening, which are adapted to be received in the recesses in the lower end of the drill bit when positioned in the opening in the bit breaker. These breakout lugs are engageable with the drill bit and prevent its rotation relative to the bit breaker, so that upon rotation of the Kelly drive, the bit breaker and drill bit rotate along with it. This enables the Kelly drive to rotate the drill bit in one direction to effect a threaded connection between the threaded pin on the bit and a drill string having an internally threaded lower end portion, and in the other direction to disconnect the bit from the drill string.

As indicated, bit breakers of the above-noted type are designed for drill bits of a predetermined size or diameter. While it may be possible to use the bit breaker for drill bits of slightly different diameter than the predetermined diameter (e.g., $\frac{3}{8}$ inch larger diameter) the bit breaker cannot be used for drill bits of significantly larger diameter than the design size because the bits cannot be received in the opening in the bit breaker or bits of significantly smaller diameter because the bits are not engaged by the breakout lugs for holding the bit in fixed position in the opening. Since oil and gas well drilling often involves the use of drill bits of different sizes, ranging from relatively large diameter surface bits to small completion bits, a series of bit breakers having openings of different sizes are also required. This increases the cost of bit breakers for a drill rig and poses handling and storage problems.

Moreover, bit breakers of the above-described type are not usable with drill bits of the so-called "extended nozzle" type having nozzle members extending down into the recesses between adjacent roller cutters. These extended nozzles prevent entry of the breakout lugs into the recesses of a drill bit and thus positioning of the bit in the opening in the bit breaker. Specially designed bit breakers thus are required for extended nozzle drill bits. This further increases the number (and thus the cost) of bit breakers needed for certain drilling operations.

SUMMARY OF THE INVENTION

Among the several objects of this invention may be noted the provision of an improved bit breaker which is usable with tri-cone bits of all types including those having extended nozzle members; the provision of such a bit breaker which has an adjustability feature enabling its use with drill bits of different sizes within a range of sizes; the provision of such a bit breaker which is capable of replacing a number of conventional bit breakers; and the provision of such a bit breaker which is relatively simple and economical to manufacture.

In general, the bit breaker of this invention comprises a bottom engageable by the bottom of a drill bit for supporting the bit, a top having an opening therein through which the bit may be lowered into engagement with the bottom of the bit breaker, and means for selectively securing the bit in fixed annular position in said opening in the bit breaker. Said securing means comprises a stop member slidably mounted on the top of the bit breaker adjacent the opening therein for movement inwardly and outwardly relative to the opening between an extended position and a retracted position. In its extended position, the stop member engages the side of the drill bit when in the opening for holding the drill bit against rotation relative to the bit breaker, and its retracted position, the stop member is spaced from the drill bit to enable the drill bit to be raised and lowered through the opening. The securing means further comprises means for selectively locking the stop member in its extended position, thereby preventing retraction of the stop member when the drill bit is rotated.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Referring to the Figs. there is generally indicated at 1 a bit breaker of this invention adapted to be fitted in the socket of a Kelly drive of a drill rig (not shown) for detachably securing a drill bit (such as shown in phantom at 3) to the Kelly drive. This enables the Kelly drive to rotate the bit relative to a drill string (a portion of which is shown in phantom at 5 in FIGS. 2 and 5) having an internally threaded lower end portion and suspended above the drill bit. When the bit 3 is rotated in one direction, a threaded connection between the threaded pin (shown in phantom at 7) at the upper end of the bit and the drill string 5 is effected. Conversely, when the bit is rotated in the opposite direction, a threaded connection between the bit 3 and the drill string 5 is broken (i.e., disconnected).

Figure 1:
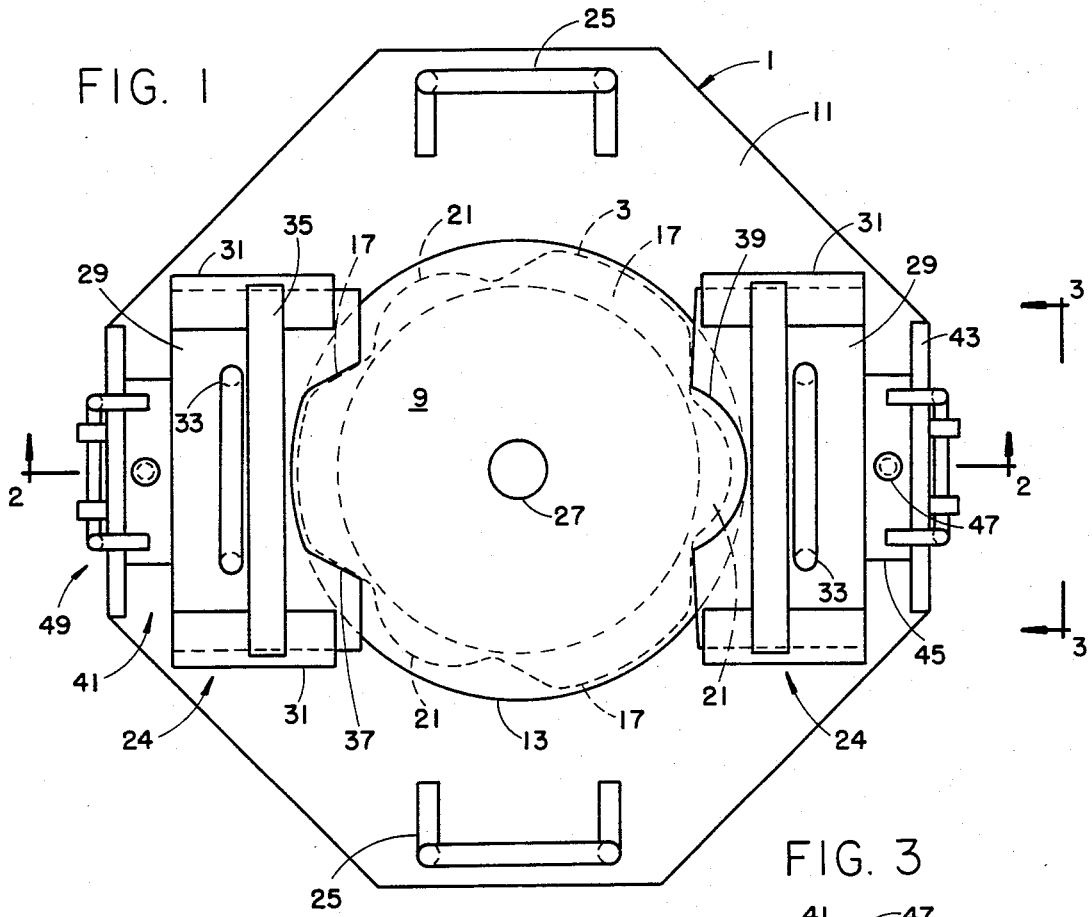
FIG. 1 is a top plan of a bit breaker of this invention having stop members shown in their extended position in which they engage a drill bit (shown in phantom) in the bit breaker.
Figure 3:
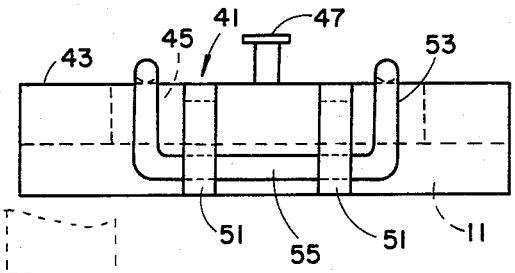
FIG. 3 is an enlarged partial side elevation of the bit breaker on line 3—3 of FIG. 1 showing one of two movable lock members of the bit breaker in its locking position.
Figure 2:
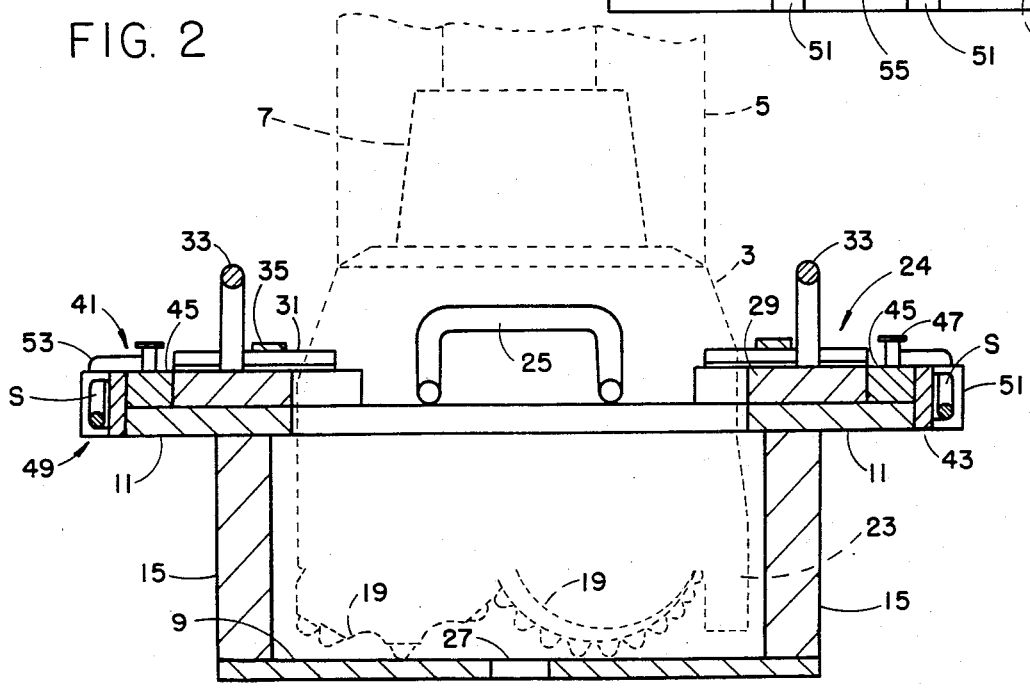
FIG. 2 is a vertical central section of the bit breaker on line 2—2 of FIG. 1.
Figure 4:
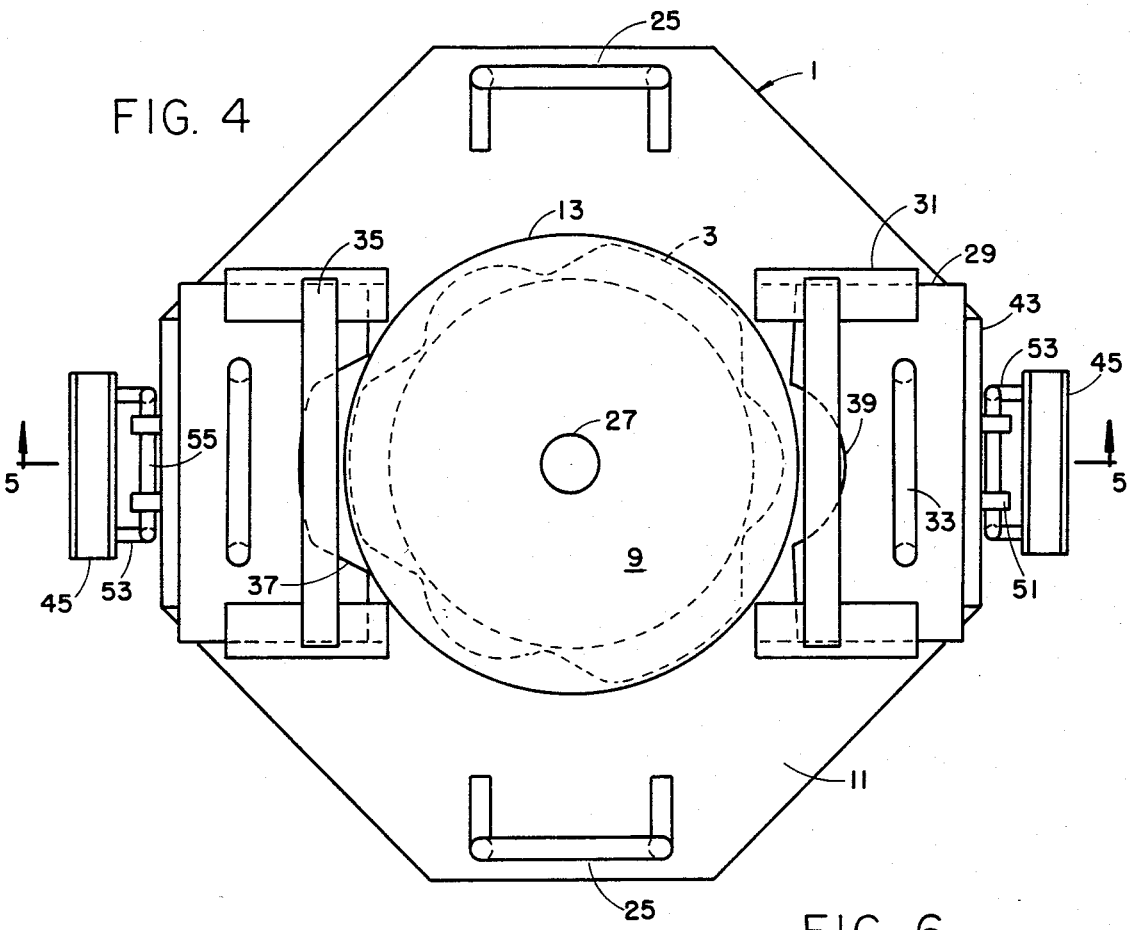
FIG. 4 is a view similar to FIG. 1 but with the stop members in their retracted position and the lock members in their unlocked position.

As shown in FIGS. 1 and 2, the bit breaker 1 comprises a bottom 9 engageable by the bottom of the drill bit for supporting the bit in the Kelly drive, and a top 11 having a generally circular opening 13 therein through which the bit may be lowered into engagement with the bottom 9 of the bit breaker and raised to remove the bit from the bit breaker. Side walls 15 extend between the bottom and top, with the side walls being of a height such that, with the bit supported on the bottom 9 of the bit breaker, the body portion of the bit is at the level of the top 11. As shown in FIGS. 1 and 4, the bit 3 at its body portion has three relatively large vertically extending projections with the nozzles 23.

Figure 5:
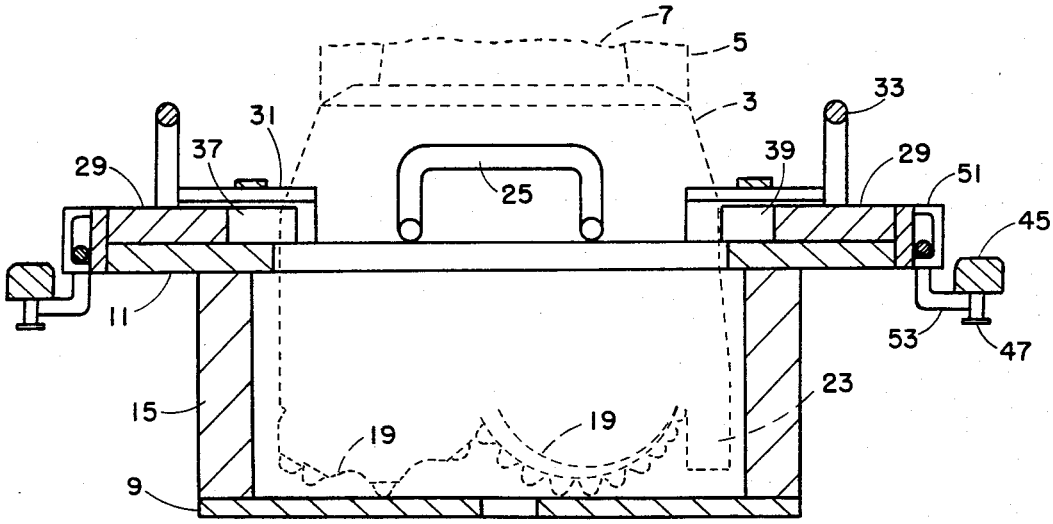
FIG. 5 is a vertical central section of the bit breaker on line 5—5 of FIG. 4.

As shown in FIGS. 1 and 2, with bit 3 in the bit breaker 1 and the stop members 29 in extended position, one of the projections 17 is received in the recess 37 and one of the projections 21 is received in the recess 39. The stop member thus holds the drill bit against rotation relative to the bit breaker, so that upon rotation of the Kelly drive, the bit breaker 1 and the drill bit 3 rotate along with it. With the stop members 29 in retracted position, as shown in FIGS. 4 and 5, the drill bit 3 may be lowered through the opening 13 into engagement with the bottom 9 of the bit breaker or raised through the opening to remove it from the bit breaker.

The securing means 24 further comprises a pair of lock means 41, one for each stop member, for selectively locking the stop members in their extended positions, thereby preventing retraction of the stop members when the drill bit is rotated. Each lock means 41 includes a fixed lock member 43, comprising a length of steel strip, secured to the top 11 of the bit breaker outwardly of the stop member, and a movable lock member 45 comprising a length of bar stock having a handle or knob 47 secured thereto. The fixed lock member 43 is engaged by the stop member 29 when in retracted position.

Means 49 on the fixed lock members 43 mounts the movable lock members 45 for pivotal movement between a locking position in which the movable lock member is between the stop member 29 and the fixed lock member 43, and an unlocking position in which it is spaced from the stop member. In its locking position, the movable lock member engages the respective stop member for holding it in extended position and, in its unlocking position, leaves the stop member free to be moved to its retracted position. The means 49 for pivotably mounting the movable lock member comprises a pair of U-shaped brackets 51 secured at their ends to the side of the fixed lock member 43 to form vertically extending slots S, and a generally U-shaped swing arm 53 having fingers at its upper ends secured to the movable lock member and a generally horizontal central reach 55. The central reach 55 of the swing arm or ridges 21 associated with the nozzles 23 of the bit. The bit breaker further has means 24 engageable with the projections 17, 21 on the bit for selectively securing the bit in fixed annular position in the opening 13.

The top, bottom and side walls of the bit breaker are formed of metal plate, such as low-carbon steel plate, and are secured together as by welding. The top 11 is so sized and configured as to fit in the socket of the Kelly drive with the outer edge margin of the underside of the top 11 bearing on the shouldered portion of the Kelly drive. A pair of handles 25 is secured to the top at opposite sides thereof to facilitate handling of the bit breaker. The bottom 9 is suspended beneath the top 11 via sides 15 when the bit breaker is in the Kelly drive for supporting the drill bit 3 over the well bore. An opening 27 is provided in the bottom 9 for drainage of fluids from the bit breaker.

The means 24 for selectively securing the bit in the opening comprises a pair of plate-like stop members 29 slidably mounted on the top 11 adjacent the opening 13 at opposite sides thereof. Each stop member is positioned in a track formed by a pair of parallel angles 31 secured to the top with one leg of each angle extending vertically and the other leg extending horizontally toward the other angle. A handle 33 is secured to each stop member 29. The handle, together with a strip 35 secured to the angles 31, constitute means for retaining the stop member in the track in an inward direction. Each track extends generally radially with respect to the opening 13, and thus guides the respective stop member 29 for movement radially inwardly and outwardly relative to the opening between an extended position (see FIGS. 1 and 2) and a retracted position (see FIGS. 4 and 5). In its extended position, the stop member engages the side of the drill bit in the opening and, in its retracted position, it is spaced from the opening. One of the two stop members 29 at its bit engaging face has a recess 37 corresponding to the drill bit projections or ridges 17 associated with the roller cutters 19. The other stop member at its bit engaging face has a recess 39 corresponding to the projections or ridges 21 associated and the brackets 51 together constitute a pin and slot arrangement providing lost motion for the movable lock member. This enables the movable lock member 45 to be pivoted past the fixed lock member 43 and moved down into locking position between the fixed lock member and the stop member.

Figure 7:
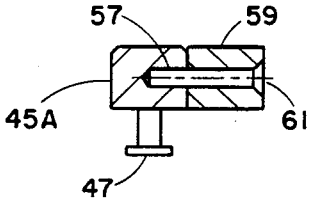
FIG. 7 is a transverse section of the lock member on line 7—7 of FIG. 6.
Figure 6:
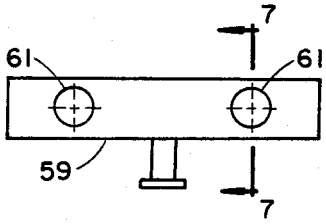
FIG. 6 is a side elevation of a lock member of alternative construction for enabling the bit breaker to be used for bits of different sizes.

An alternative construction of the movable lock member, designated 45A, for enabling the bit breaker to be used for bits of different sizes within a range of sizes is shown on FIGS. 6 and 7. The lock member 45A is similar to the lock member 45 except that it has a pair of blind end threaded bores 57 for enabling shim plates 59 of varying thickness to be detachably secured thereto by screws 61. The movable lock member 45A is thus made adjustable in its dimension as measured from its stop member engaging face to its fixed lock member engaging face for holding the stop member in different extended positions, one for each different bit size. Accordingly, by changing the shim plates 59 the bit breaker 1 may be adapted to receive bits of different sizes.

It will be observed from the foregoing, the improved bit breaker of this invention is usable not only for conventional tri-cone drill bits having recesses at their lower ends between adjacent roller cutters, but also for drill bits, such as extended nozzle drill bits shown for example at 3 in FIGS. 2 and 5, having no recesses at their lower ends. In addition, the bit breaker of this invention, because of its adjustability feature, is usable with drill bits of different sizes within a range of size.

While the bit breaker is shown and described above as having a pair of stop members, it is contemplated that the bit breaker may have only one stop member or may have three or more stop members. Moreover, while the stop members are shown and described as being mounted for movement radially with respect to the opening, it is contemplated that they may be mounted for movement inwardly and outwardly with respect to the opening along other than a radial line.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bit breaker adapted to be fitted in the Kelly drive of a drill rig for detachably securing a rotary drill bit to the Kelly drive to enable the latter to rotate the bit relative to a drill string having an internally threaded lower end portion in one direction to effect a threaded connection between the threaded pin of the bit and the string, and in the other direction to disconnect the bit from the string; said bit breaker comprising:

a bottom engageable by the bottom of a bit for supporting the bit;

a top having an opening therein through which the bit may be lowered into engagement with the bottom of the bit breaker and may be raised to remove the drill bit from the bit breaker; and means for selectively securing the bit in fixed annular position in said opening in the bit breaker comprising a stop member slidably mounted on the top of the bit breaker adjacent the opening therein for movement inwardly and outwardly relative to the opening between an extended position in which the stop member engages the side of the drill bit when in the opening for holding the drill bit against rotation relative to the bit breaker and a retracted position in which the stop member is spaced from the drill bit to enable the drill bit to be raised and lowered through the opening, and means for selectively locking the stop member in its extended position, thereby preventing retraction of the stop member when the drill bit is rotated.

2. A bit breaker as set forth in claim 1 wherein the stop member has a generally U-shaped end engageable with the side of the bit, the recess in the engaging end of the stop member being adapted to receive a projecting portion on the side of the drill bit.

3. A drill breaker as set forth in claim 1 wherein said securing means comprises a pair of said stop members mounted on the top of the bit breaker at generally opposite sides of the opening in the top.

4. A bit breaker as set forth in claim 1 wherein the lock means comprises a fixed lock member secured to the top of the bit breaker laterally outwardly of the stop member, the fixed lock member being engageable by the stop member when in its retracted position, and a movable lock member adapted to be positioned between the fixed lock member and the stop member for holding the stop member in its extended position.

5. A bit breaker as set forth in claim 4 which is adapted to receive bits of different sizes within a range of sizes, the stop means being movable to a plurality of extended positions, one for each different bit size, and the lock means being adjustable so as to hold the stop means in the respective extended position for each bit.

6. A bit breaker as set forth in claim 5 wherein the movable lock member in its dimension as measured between its stop member and its fixed lock member engaging faces is adjustable so as to position the stop member at different distances from the fixed stop member and thus in different extended positions.

7. A bit breaker as set forth in claim 4 further comprising means for pivotally mounting the movable stop member for movement between a locking position in which the movable lock member is between the stop member and the fixed lock member, and an unlocking position in which it is spaced from the stop member.

8. A bit breaker as set forth in claim 7 wherein said pivotal mounting means comprises a slot and pivot pin arrangement.

9. A bit breaker as set forth in claim 1 wherein the stop member is slidably mounted in a track on the top of the bit breaker.

10. A bit breaker as set forth in claim 9 further comprises means for retaining the stop member in the track.

* * * * *